US006660967B2

(12) United States Patent
Brofft et al.

(10) Patent No.: US 6,660,967 B2
(45) **Date of Patent: *Dec. 9, 2003**

(54) POWER BOX

(75) Inventors: Roger W. Brofft, Loveland, OH (US); Roger Lee Rieckers, Georgetown, IN (US); William Roland Cooper, Clarksville, IN (US)

(73) Assignees: Senco Products, Inc., Cincinnati, OH (US); Dynamic Power Source, LLC, New Albany, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/941,150

(22) Filed: Aug. 28, 2001

(65) Prior Publication Data

US 2003/0042237 A1 Mar. 6, 2003

(51) Int. Cl.[7] ..... H05B 7/144
(52) U.S. Cl. ..... 219/133; 290/1 R
(58) Field of Search ..... 219/133, 134; 290/1 A, 1 R; 137/899.4

(56) References Cited

U.S. PATENT DOCUMENTS

| | | | | | |
|---|---|---|---|---|---|
| 1,947,713 | A | * | 2/1934 | Gumpper | 123/198 E |
| 2,364,013 | A | | 11/1944 | Waseige | 290/1 |
| 2,789,756 | A | * | 4/1957 | Allen | 137/899.4 |
| 3,035,757 | A | * | 5/1962 | Poore et al. | 417/8 |
| 3,514,219 | A | | 5/1970 | Mitchell et al. | 417/364 |
| 3,770,976 | A | | 11/1973 | Stroud et al. | |
| 4,173,951 | A | | 11/1979 | Ishihara | 123/2 |
| 4,293,281 | A | * | 10/1981 | Lamoreaux | 417/9 |
| 4,930,550 | A | * | 6/1990 | Czerwinski et al. | 137/334 |
| 5,087,824 | A | | 2/1992 | Nelson | 290/1 A |
| 5,125,236 | A | | 6/1992 | Clancey et al. | |
| 5,203,857 | A | * | 4/1993 | Terwilliger et al. | 137/533.29 |
| 5,341,644 | A | * | 8/1994 | Nelson | 60/627 |
| 5,518,032 | A | * | 5/1996 | Berke | 137/559 |
| 5,599,470 | A | | 2/1997 | Peotter et al. | |

(List continued on next page.)

FOREIGN PATENT DOCUMENTS

| | | |
|---|---|---|
| WO | WO 01/43272 | 4/2000 |
| WO | WO 01/12967 A1 | 2/2001 |

OTHER PUBLICATIONS http://www.millerwelds.com/professional/products/enginedriven/M10200/ and features/, *Miller. The Power of Blue. Products. Miller Air Pak*, Miller Electric Website, Oct. 2001.

Trak Honde & MegaJet, *Megajet 4 in 1 Workstation*, http://wwww.megajet.com.au/index.html;1997–2000.

High Technology Welding Equipment, *The best of Esseti Technology to challenge year 2000 and beyond.*, Product Brochure, 2000.

(List continued on next page.)

*Primary Examiner*—M. Alexandra Elve
*Assistant Examiner*—Kevin McHenry
(74) *Attorney, Agent, or Firm*—Wood, Herron & Evans, L.L.P.

(57) ABSTRACT

An integrated power unit for use in a bed of a pickup truck. A lower housing is sized to fit between the rear wheel wells of the pickup truck, and opposed upper housings extend over respective opposed sidewalls of the truck bed. The opposed upper housings are adjustable with respect to the lower housing, so that the integrated power unit may be used with various makes and models of pickup trucks. The lower housing contains an internal combustion engine for generating mechanical power, an alternator and electrically driven compressors. Ducting and baffles facilitate air flow and cooling in the lower housing. A fuel tank is formed by one of the upper housings, and a control panel is located in the other upper housing. Connections for electrical power and regulated and unregulated pneumatic power are available at the control panel.

41 Claims, 7 Drawing Sheets

U.S. PATENT DOCUMENTS

| | | | | | |
|---|---|---|---|---|---|
| 5,899,174 | A | | 5/1999 | Anderson et al. | |
| 6,051,809 | A | * | 4/2000 | Colella | 219/133 |
| 6,065,942 | A | * | 5/2000 | Glidden et al. | 417/236 |
| 6,085,770 | A | | 7/2000 | MacNeal et al. | |
| 6,099,265 | A | | 8/2000 | Rowe et al. | |
| 6,102,672 | A | * | 8/2000 | Woollenweber et al. | 417/366 |
| 6,103,995 | A | | 8/2000 | Bankstahl | |
| 6,296,027 | B1 | | 10/2001 | Bender et al. | |
| 6,362,533 | B1 | * | 3/2002 | Morohoshi et al. | 123/41.56 |
| 6,489,591 | B1 | | 12/2002 | Achtner | |
| 6,547,527 | B2 | | 4/2003 | Gaither | |
| 2001/0000607 | A1 | | 5/2001 | Trinker et al. | |

OTHER PUBLICATIONS

Multiquip, Inc., *Construction & Power Generation; 1999 Equipment Guide*, Product Brochure, 1999.

The Lincoln Electric Company, *Welding the World Together*, Equipment Products Catalog, Sep. 1999.

Miller Electric Mfg. co., *Full–Line Catalog 2000*, Products Brochure, 2000.

Thermal Arc Inc., A Thermadyne Company, *Power–Plus Series, Predator*, Products Brochure, 1999.

Thermadyne Industries, Inc., *Take A Look At What's New*, Products Brochure, Spring/Summer 2000.

Thermal Arc, Inc., A Thermadyne Company, *Why is everyone asking if you've Got Power?*, Products Brochure, 2000.

Thermadyne, *Innovative Solution For All Your Cutting and Welding Needs.*, Products Brochure Jul. 1999.

Thermal Arc. Inc., A Thermadyne Company, *2000 Welding Products Catalog*, Products Catalog, 2000.

* cited by examiner

POWER BOX

FIELD OF THE INVENTION

The present invention relates to power generating units such as compressors, electrical generators and welding power supplies, and particularly units of this type that can be transported to a work site.

BACKGROUND OF THE INVENTION

Portable units that can be carried to a site are known, and a typical unit of this type, such as a TS 200, Model 5000 welder/generator sold by Burco/Mosa, includes an open, lightweight frame consisting of a metal shell on which is mounted an internal combustion engine directly connected to an alternator, which generates sufficient amperage to operate direct current welders and to provide some auxiliary alternating current for operating auxiliary equipment. A engine is also mechanically coupled to a compressor that may be used to provide the compressed air needed to operate a plasma cutting torch used in conjunction with the welding equipment.

While units of this type operate satisfactorily, they have several disadvantages. First, and most importantly, even though the welder/generator or compressor is portable, it is nevertheless difficult and time consuming to load and unload, then connect up the various components which are included in the system. More specifically, in a typical operation, the portable welder/generator, which may weigh approximately 400 pounds, is lifted onto the bed of a pickup truck. Because it is so heavy, it is usually placed at the rear of the bed to avoid unnecessary lifting, and because it is so big, it creates an obstacle that makes it difficult to place any significant equipment in the pickup truck. Next, the compressor, which is a separate unit and also heavy (e.g. 150 pounds), must be lifted and placed on the bed of the pickup truck. At the job site, these units are generally unloaded from the truck, and in any event, they must be connected to one another, and with the welding and plasma cutting equipment, all of which is time consuming and often requires additional lifting of heavy equipment.

Moreover, even though the individual components of the system are relatively heavy, they nevertheless can be stolen and carried away from the back of a pickup truck. Therefore, it is the general practice of those who use such equipment to unload and properly store the equipment in a secure location at the end of each working day, and again, this results is a significant amount of lifting of heavy equipment. The same is true for smaller, auxiliary tools that are used with these units, such as plasma cutters, mig welders and/or welding leads, all of which must also be removed from the truck and stored.

Finally, in such known units, the tubular frame in which the internal combustion engine and the alternator are carried is entirely open, and, as a result, workmen and others located near the equipment are constantly exposed to very high levels of noise resulting from the operation of the engine, the alternator, and the associated compressor unit.

Colella, U.S. Pat. No. 6,051,809, describes a welder/generator and compressor unit that is sized to fit in the bed of a pickup truck. Specifically, the unit has a generally T-shaped cross section, with a lower housing portion sized to fit between the bed walls of a standard pickup truck bed. The upper portion of the housing is somewhat wider, extending over and resting on the bed walls, thus forming the T-shape. On one end of the upper portion of the housing are controls for connection to the welder/generator and compressor. Within the housing are various components including an internal combustion engine, alternator, and air compressor, as well as a compressed air tank for storing compressed air produced by the compressor, a battery, electrical and compressed air connections and a storage area. The engine, alternator and compressor are mounted in longitudinal alignment, with the drive shaft of the engine directly mechanically driving the shaft of the alternator and also mechanically driving the shaft of the air compressor through a speed-reducing pulley arrangement.

The Colella device has the advantage of being easily transportable in the pickup truck bed, and having conveniently located controls and connections to permit use of all of the units without removal from the pickup truck. Furthermore, the enclosed housing provided in the Colella device allows for some reduction of noise.

Unfortunately, the device shown in the Colella patent has a number of drawbacks. First, there is no provision in the described device for storage of fuel for the engine. Presumably, a fuel tank would be provided within an unused portion of the housing or in the truck bed adjacent to the unit. In such a position, the tank would be difficult to access for refueling. Furthermore, in typical use, the Colella device would remain within the pickup truck bed at all times. Therefore, when the fuel tank (wherever positioned) is refilled, spilled fuel would fall into the housing or truck bed soiling the bed or housing and creating a potential safety hazard. Similarly, the Colella patent does not describe a purge valve for the compressed air tank which would be needed to purge condensed water from the tank. Typically, such a valve is located on the tank. However, such a location would be inconvenient. Also, when a purge valve on the compressed air tank is opened to purge water from the tank, water is likely to be emitted into the housing, introducing unwanted moisture into the housing.

A second difficulty with the Colella design is that it is sized to fill the entire width of a pickup truck bed. As a consequence, the unit can only be readily installed adjacent the tailgate of the truck bed, to the rear of the wheel wells, for the reason that the width of the unit prevents sliding the unit past the wheel wells. Although the unit may be lifted over the wheel wells to a forward position in a short bed truck, the unit may be required to be placed in a rearward position for the reason that a short bed truck permits insufficient space (only about one foot) for the Colella unit to fit between the wheel wells and forward end of the truck bed. Positioned in a rearward bed location, the unit limits other uses of the truck bed, as items must be lifted over the bed walls to be placed in the bed, rather than sliding those items into the bed via the tail gate. Furthermore, with the Colella unit in the truck bed, the length of the bed is shortened such that the bed may no longer accommodate typical construction materials such as plywood sheets.

A third difficulty with the Colella design arises when fitting the unit to pickup trucks of different makes and models. While there is, to a reasonable extent, a standard pickup bed width, there is no standard height for pickup bed walls. As a result, the intended fit of the Colella unit, to rest on the pickup walls, will likely be correct for only a certain class of pickups. When the unit is installed in other classes of pickups, it is likely to either rest on the floor of the truck bed with the upper housing sections inconveniently elevated above the top of the bed walls, or, alternatively, rest on the top of the bed walls but with a substantial gap between the bottom of the housing and the bed floor. In the former case, the housing floor would need to be designed to distribute weight to prevent damage to either the unit or truck bed when the unit is resting on its bottom surface. The only way to avoid such issues would be to reduce the height of the lower housing of the unit to a height less than the shortest bed wall in which the unit might be used, which would reduce the volume of the housing available for the identified components.

In addition to the foregoing difficulties, there is the further complication that the total weight of the various elements called for in the Colella patent can easily approach 800 pounds, exceeding the weight that can be supported by typical truck bed rails, and requiring substantial reinforcement of the upper housing portions to support the unit in the intended manner.

A further difficulty with the Colella unit arises from the manner in which elements are positioned within the housing. The longitudinal, mechanically coupled arrangement of the engine, alternator and compressor makes efficient use of the space; however, it hinders the efficient flow of cooling air to those elements since such units are typically designed to obtain or exhaust cooling air in the longitudinal direction, and each element is longitudinally abutting either another element or the housing and truck bed walls. As a consequence, cooling air flow may be restricted and/or heated air may be caused to flow from one unit onto another, limiting cooling.

Finally, the Colella unit, while portable, may have limitations in some environments where a pickup truck cannot be positioned close to the work area, for example, where welding is being performed deep within a structure, it may be inconvenient, or detrimental to weld power, to run long electrical leads carrying welder voltages and currents from an externally-parked pickup truck to the work site.

SUMMARY OF THE INVENTION

The present invention provides a compact, efficient and secure integrated power unit for use in a bed of a pickup truck. The integrated power unit of the present invention is fully self contained, user friendly and relatively quiet in operation. The integrated power unit of the present invention conveniently fits at the forward end of a pickup truck bed and even fits between the rear wheel wells of the truck bed. Further, the integrated power unit of the present invention can be adjustably assembled so that it can be easily installed in a wide range of different pickup trucks. The integrated power unit of the present invention is especially useful where a wide range of power requirements are necessary. The integrated power unit of the present invention readily provides regulated and unregulated compressed air and an electrical power supply, thereby providing power for a wide range of electrically and pneumatically powered tools.

According to the principles of the present invention and in accordance with the preferred embodiments, the invention provides an integrated power unit for use with a pickup truck. The power unit has a lower housing located between opposed side walls in the truck and an upper housing that extends from the lower housing and over a sidewall of the truck bed. An electrical power generating unit and a plurality of electrical breakers are also located in the lower housing.

In another embodiment, the lower housing of the integrated power unit has a lid movable with respect to the lower housing and a switch mounted in the lower housing to detect when the lid is opened and closed. The switch is electrically connected with the internal combustion engine and disables the engine in response to the lid being opened.

In a further embodiment of the invention, the integrated power unit has a compressor located in the lower housing connected to the electrical power generating unit. A compressed air tank is also located in the housing and is connected to the compressor. A control panel has a gauge fluidly connected to the compressed air tank for displaying fluid pressure within the compressed air tank. In one aspect of this invention, the control panel is mounted in the upper housing. In another aspect of this invention, the control panel has a switch for enabling and disabling the compressor.

In a still further embodiment of the invention, the integrated power unit has an internal combustion engine and a first air flow path within the lower housing for receiving cooling air from outside the housing and directing the cooling air past the engine to a location outside of the housing. In addition, the integrated power unit has a power converting unit connected to the engine and a second air flow path within the lower housing. The second air flow path receives cooling air from outside the housing and directs the cooling air past the power converting unit to a location outside of the housing. In various aspects of this embodiment, the air flow paths extend through different walls of the integrated power unit.

The above and other objects and advantages of the present invention will become more readily apparent during the following detailed description taken in conjunction with the drawings herein.

BRIEF DESCRIPTION OF THE DRAWING

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF SPECIFIC EMBODIMENTS

Figure 1:
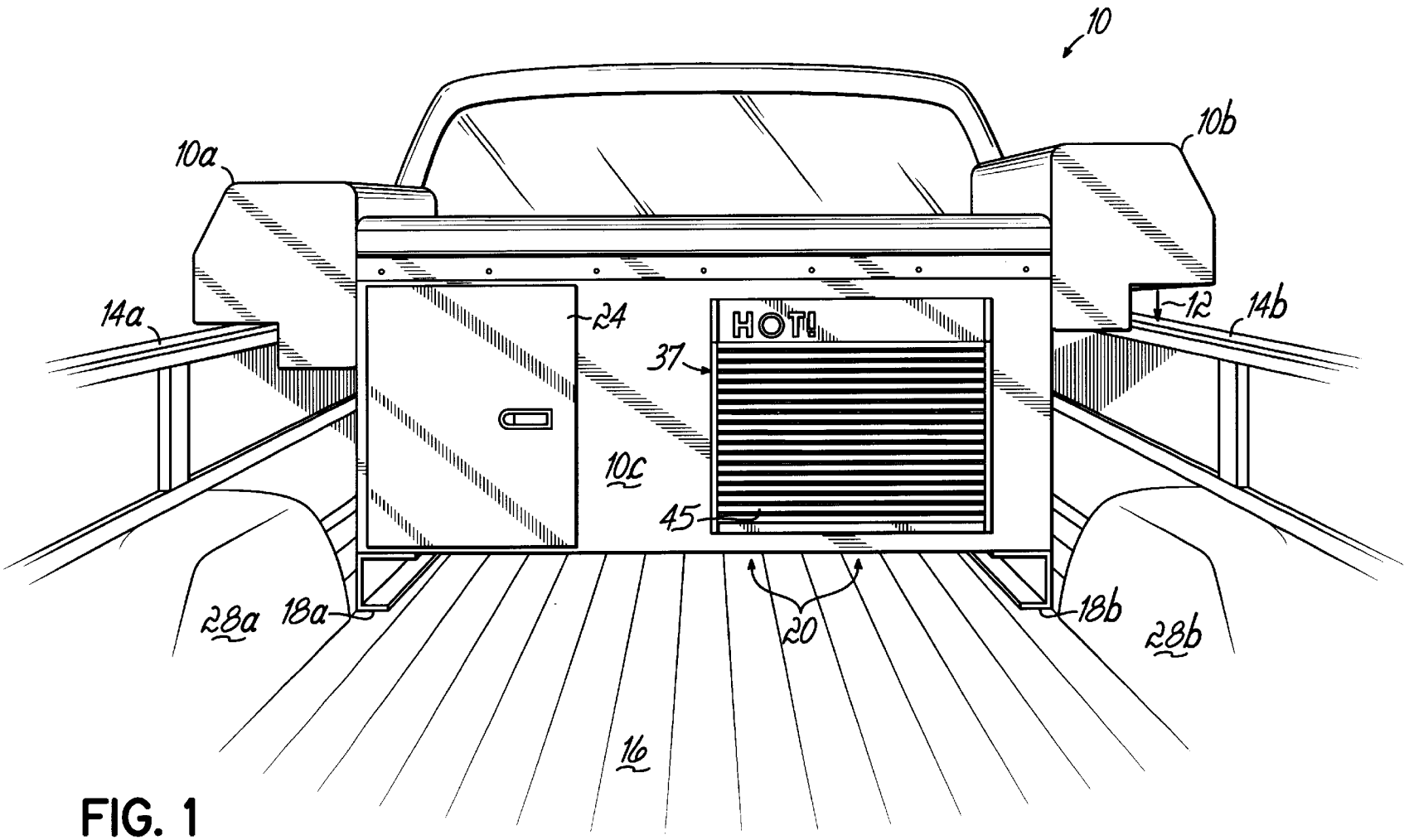
FIG. 1 is a partial perspective view of the rear of an integrated power unit in accordance with the principles of the present invention.

Referring to FIG. 1, an integrated electrical and mechanical power generating unit in accordance with the principles of the present invention can be further described. An integrated unit 10 is shown positioned within the bed of a full size pickup truck. The integrated unit 10 comprises upper housings 10*a* and 10*b* which form bolsters, and a lower housing 10*c* which rests in the bed of the pickup truck.

As will be discussed in further detail below, bolsters 10*a,* 10*b* are vertically adjustable in the direction of arrow 12 so that bolsters 10*a,* 10*b* may be positioned to rest upon the sidewalls 14*a,* 14*b,* respectively, of the pickup truck bed. In this manner, bolsters 10*a,* 10*b* rest upon the sidewalls 14*a,* 14*b* of the pickup truck bed, while the lower housing 10*c* rests upon the floor 16 of the pickup truck bed. The greatest portion of the weight of the unit rests upon the pickup truck bed, with the bed walls supporting only the weight of the respective bolsters 10*a,* 10*b.*

Lower housing 10*c* includes feet 18*a,* 18*b* which rest upon the floor 16 of the pickup truck bed, and thus hold lower housing 10*c* in a position somewhat above the floor 16 of the pickup truck bed. In this way, feet 18*a,* 18*b* create a space or gap 20 beneath lower housing 10*c* which may be used for a storage drawer or for elongated cargo such as plywood sheets.

Figure 2:
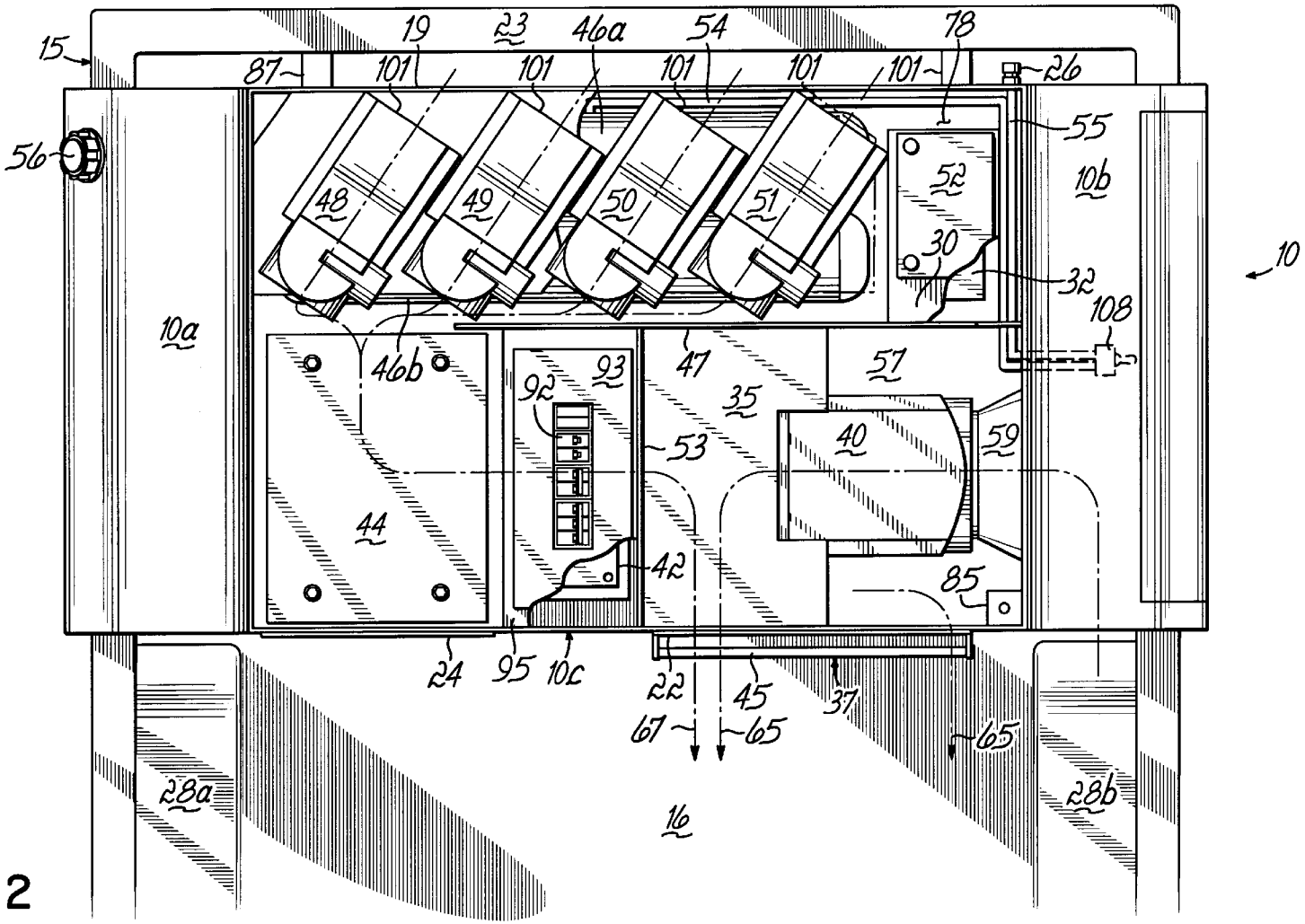
FIG. 2 is a top elevation view of the integrated power unit of FIG. 1.
Figure 5:
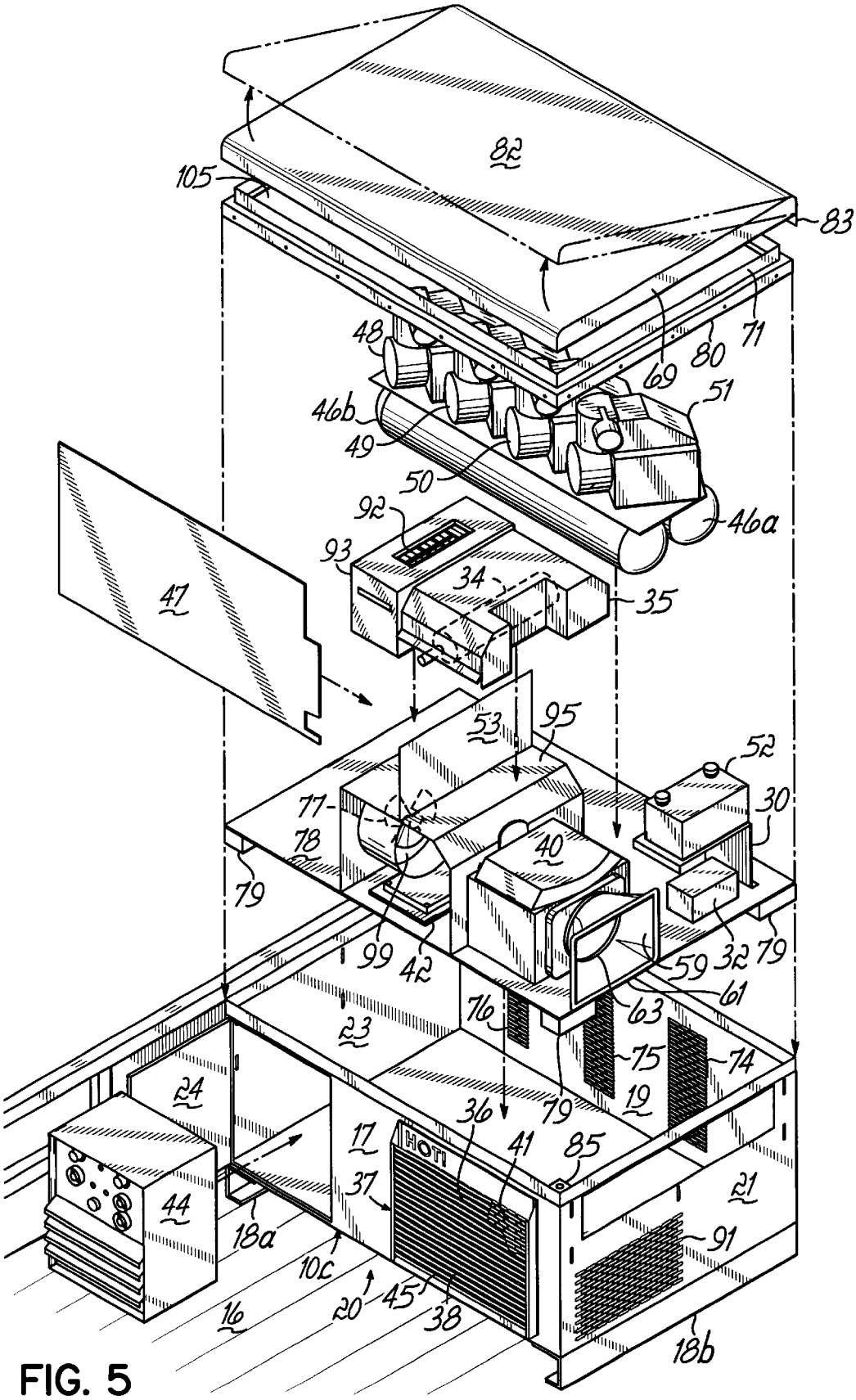
FIG. 5 illustrates a perspective view of a lower housing of the integrated power unit of FIG. 1 in which major components are shown disassembled therefrom.

The rear surface of lower housing 10*c* includes an access door 24 providing access to a closet space 27 that is used to hold a welding power generator unit 44 (FIGS. 2 and 5). The lower housing 10*c* further includes a purging outlet drain 26 (FIG. 2) for emitting moisture purged from pressurized gas tanks within power generating unit 10, as explained in further detail below.

It will be seen that the lower housing 10*c* of the power generating unit 10 is sized so as to fit between the wheel wells 28*a,* 28*b* on a conventional full size pickup truck bed. This permits the power generating unit 10 to be positioned at any desired location within the pickup truck bed, including a fully forward position as shown in FIG. 1, a fully rearward position, and a position between the wheel wells 28*a,* 28*b.*

Referring to FIG. 2, details of the internal structure of power generating unit 10 can be explored. A first component within the lower housing 10*c* of the power generating unit 10 is an internal combustion engine 40, such as an air cooled, two cylinder, gasoline engine, providing mechanical power for the remaining elements of the power generating unit 10. Engine 40 is arranged longitudinally to produce mechanical torque on a shaft extending outward from engine 40 and into an alternator unit 42 that is separate from the engine 40. Alternator unit 42 produces electrical power from rotation of the shaft of engine 40, which electrical power may be used by other elements of the power generating unit 10.

A first element using electrical power is a welding power supply 44 positioned, as noted above, behind door 24 to permit access thereto. Welding power supply 44 converts three-phase alternating current electrical power from alternator unit 42 into welding voltages to be used in electrical welding. Welding unit 44 may be docked into power generating unit 10 in the position shown in FIG. 2, or may be removed via door 24 to a remote location and used at that remote location for welding. In either case, conductors carry three-phase electrical power from alternator unit 42 to welding power supply 44.

Engine 40, alternator unit 42 and welding power supply 44 are contained within a first baffled compartment of lower housing 10*c*. A longitudinal baffle 47 extending longitudinally across the lower housing 10*c* separates engine 40, alternator unit 42 and welding power supply 44 from a second baffled compartment containing compressors and air tanks as discussed below. This provides that the compartments have separate air flow paths to facilitate cooling, as is elaborated below.

Within this second compartment, air tanks 46*a,* 46*b* store compressed air produced by compressors 48–51 positioned within the compartment above. Compressors 48–51 are electrically powered compressors driven by electrical power produced by alternator unit 42. The compressors 48–51 have internal fans (not shown) that receive cooling air through inlets 101 that are directed toward the front wall 19. The compressors 48–51 are oriented such that the inlets 101 are immediately adjacent the vents 74–76 (FIG. 5), so that there is a direct and unobstructed ventilation air flow through the vents 74–76 to the inlets 101 of the compressors 48–51. Thus, respective longitudinal centerlines of the compressors 48–51 are nonperpendicular and angled with respect to a longitudinal centerline of the truck bed 15. The angular orientation of the compressors 48–51 provides a plurality of parallel cooling air flow paths that better direct the cooling air around the welding unit 44 and into a compartment housing the alternator 42. Compressors 48–51 generate compressed air which is stored within tanks 46*a,* 46*b* and available as compressed air through a control panel in bolster 10*b* as is described in detail below.

Within the same compartment as compressors 48–51 and positioned above tanks 46*a,* 46*b* is a battery 52 that is used to drive a starter of engine 40. The battery 52 is supported by a bracket 30 that is mounted to the support plate 78 by fasteners, welding or other known means. The bracket 30 bounds an enclosed volume in which a capacitor pack 32 is located.

Referring to FIG. 2, air tanks 46*a*, 46*b* are purged by a hose 54 connected to a manual push button purge valve 108 in bolster 10*b* and a hose 55 connected between the purge valve 108 and purge outlet 26. To purge excess moisture from air tanks 46*a*, 46*b*, this manual purge valve within control panel 25 is actuated, causing compressed air to force moisture through hoses 54, 55 and out outlet 26.

Standoff pads 87 are fixed to the front wall 19 of the lower housing 10*c*. The standoffs 87 are made of a resilient material and are used to position the lower housing 10*c* a desired distance from the front wall 23 of the truck bed 15. The space provided by the standoff pads 87 between the front truck bed wall 23 and the front wall 19 of the lower housing 10*c* permits air to circulate adjacent the front wall 19 and enter the vents 74–76 (FIG. 5).

Referring to FIG. 5, the top of lower housing 10*c* has an opening 105 coverable by a top door or lid 82. The opening 105 is surrounded by a mounting frame 80 for the lid 82. The lid 82 may be completely removable from the mounting frame 80 or be pivotally connected to the mounting frame 80 by means of a hinge 83. One or more latches (not shown) can be used to secure the lid 82 to the lower housing 10*c*. Compressed air lifters (not shown) can be interposed between lid 82 and lower housing 10*c,* so that lid 82 will move to, and hold, an open position when the latch is released. The lid 82 has a peripheral groove inside its outer edge 69 that extends over and mates with a peripheral lip or standing seam 71 on mounting frame 80. That lip in groove construction provides a tight, rain-proof seal around the lid 82 and directs water away from the interior of lower housing 10*c*. Further, that construction provides greater sturdiness and security to the lid, thus making it more impervious to unauthorized entry. Similarly, surrounding the opening 105 of the lower housing 10*c* is a standing lip or seam (not shown) that fits inside a peripheral groove of the mounting frame 80. Again, that mechanical construction provides an excellent rain-proof seal and further provides rigidity to the lower housing 10*c*, thereby increasing the security of the lower housing 10*c*.

An electrical disconnect or "kill" switch 85 (FIG. 2) is mounted in the lower housing 10*c* adjacent an edge of the mounting frame 80 opposite the hinge 83. The switch 85 changes state in response to detecting the proximity of the movable forward edge of the lid 82, thereby providing an electrical signal that changes state in response to the lid 82 being opened and closed. The switch 85 is used as an electrical disconnect or "kill" switch for the engine 40. The switch 85 is electrically connected with electrical components in the internal combustion engine 40 such that when the lid 82 is opened, the switch 85 changes state, thereby terminating the operation of the engine 40. The switch 85 changes state again when the lid 82 is closed, thereby permitting the engine 40 to be restarted. As will be appreciated, the switch 85 can alternatively be mounted in the lid 82 or disposed at other locations that permit the switch 85 to detect an opening and closing of the lid 82. As will further be appreciated, the switch 85 can be a limit switch or other suitable proximity switch; and further, the switch 85 can be connected with the wiring of the engine 40 in different ways to achieve the desired result.

Opening the lid 82 provides access to the breakers 92 that are mounted within an electrical box or cabinet 93. As shown in FIGS. 2 and 5, a breaker box 93 is mounted on top of a housing 95 that forms a compartment for the alternator 42.

Referring to FIGS. 2 and 5, a first ventilation air flow path 65 is used to cool the engine compartment 57; and a second ventilation air flow path 67 is used to cool the other components in the lower housing 10*c*. The engine compartment 57 is formed by baffles 47, 53 and alternator housing 95, thereby isolating it from the other components in the lower housing 10*c*. Thus, the cooling of the engine 40 is separate from the cooling of the other components within the lower box 10*c*.

Within the engine compartment 57, the internal combustion engine 40 has an expanded air inlet duct 59 that supplies both ventilation and combustion air to the engine 40. The duct 59 is generally conically shaped with an inlet end 61 that is substantially larger than the duct outlet 63. Thus, any impediment to air flow into the engine 40, for example, a resistance to air flow presented by a vent 91 in the right end wall 21, is substantially eliminated. The engine 40 has a generally cylindrically shaped muffler 34 (FIG. 5) that is mounted within a plenum 35. Air drawn through the duct 59 is blown by a fan in the engine 40 into the plenum 35, around the muffler 34 and out through an upper portion 36 of an air vent 37 mounted on the rear wall 17. Thus, the muffler 34 is completely surrounded by cooling and insulating air that is continuously circulated within the plenum 35. The plenum 35 minimizes a transfer of heat from the muffler 34 to the interior of the lower housing 10*c*. The cooling air flow path around the engine 40 is generally shown by the flow path line 65 in FIG. 2.

The compressors 48–51 and other units to the front of the lower housing 10*c* are cooled by air flowing in through vents 74–76 located on the front wall 19. The alternator 42 has a fan 77 disposed within the opening 99 to provide other forced air ventilation within the lower box 10*c*. The alternator fan 77 and fans (not shown) in the compressors 48–51 draw cooling air through the vents 74–76, around the compressors 48–51, past the left end wall 23, past the welding unit 44 and into the alternator housing 95. The air is discharged through a lower portion 38 of the air vent 37 on the rear wall 17. The area of the vent 74 is larger than the area of the vent 75 that, in turn, is larger than the area of the vent 76. The area of the vents 74–76 is varied to equalize the flow of ventilation air over the components adjacent the front wall 19. The cooling air flow path for the compressors 48–51, welding unit 44 and alternator 42 is generally shown by the flow path line 67 of FIG. 2.

As seen in FIG. 5, the air vent 37 has ventilation holes 41 extending through the rear wall 17 of the lower housing 10*c*, thereby directing ventilation air straight out generally parallel to the floor 16 of the truck bed 15. A second, vent 45 is mounted immediately in front of, but displaced away from, the ventilation holes 41. The vent 45 is constructed with a plurality of parallel louvers 45 that are mounted at an angle in order to direct exiting ventilation air upward. Without the louvers 45, heated ventilation air exiting from the ventilation holes tends to circulate in the truck bed, hindering cooling and tending to heat other items stored in the truck bed 15. To minimize that heating effect, the louvers 45 are used to direct the heated exhaust air up away from the truck bed floor 16. As will be appreciated, alternatively, the vent holes 41 and vent 45 may be mounted to a panel that is completely removable from, or hinged to, the rear wall 17.

Bolster 10*a* is a tank storing fuel for internal combustion engine 40. Specifically, tank 10*a* is a fuel tank for storing fuel to be used by engine 40. The capacity of the fuel tank and bolster 10*a* is sufficient to maintain operation of engine 40 for at least one entire day of operation at a job site. The tank in bolster 10*a* may be refueled through an opening (not shown) in the bolster 10*a* that is closed or sealed in a known manner by a refueling cap 56 mounted on the outside surface of bolster 10*a*. Fuel filler cap 56 is located on a left side of the pickup truck and thus, on a standard pickup, will be adjacent to the fuel filler cap of pickup truck itself. Thus, fuel can be readily dispensed into the fuel tank of the pickup truck as well as into the fuel tank of the power generating unit 10. It will be further noted that the position of the fuel filler cap 56 is at an outward edge of a bolster 10*a* and further, that the outer edge of bolster 10*a* extends outward of the bed wall of a typical pickup truck. As a consequence, any fuel. spillage that occurs while filling the fuel tank in bolster 10*a* will flow to an area outside of the pickup truck bed, thus minimizing safety hazards from spilled fuel.

Figure 11:
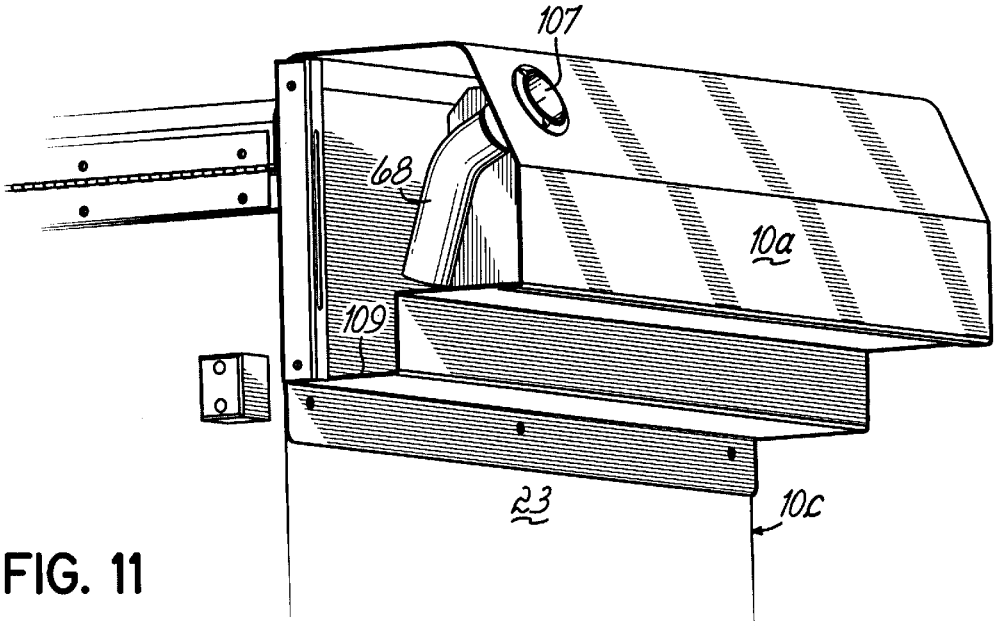
FIG. 11 is a partial perspective front view of a bolster fuel tank with one end removed as used with the integrated power unit of FIG. 1.

Referring to FIG. 11, a filler tube 68 has an upper, proximal end contiguous with the opening 107 of the fuel tank and a lower, distal end extending close to the bottom 109 of the fuel tank in bolster 10*a*. The filler tube 68 has a flapper valve (not shown) located at its upper end immediately adjacent the opening 107 in the fuel tank. The flapper valve is normally in a closed position blocking the filler tube 68, and the flapper valve is opened by a fuel nozzle being inserted therethrough to fill the tank. With the truck upright and the lower end of filler tube 68 near the bottom 109 of the tank, the filler tube 68 functions as a flame arrester by helping to prevent a flame from reaching more volatile vapors that are normally in an upper portion of the tank.

Figure 3:
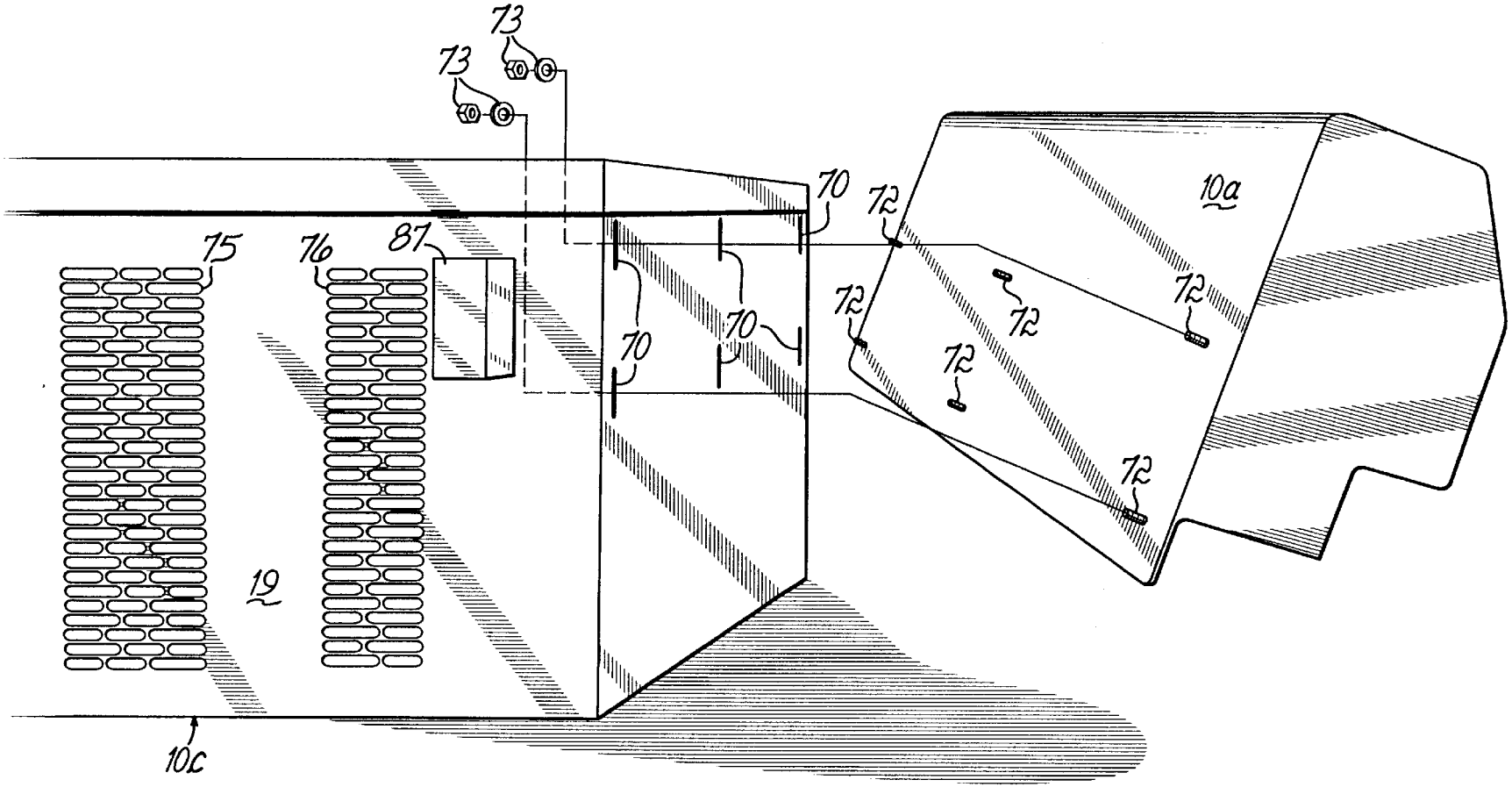
FIG. 3 is a perspective rear view of a bolster disassembled from the integrated power unit of FIG. 1.

Referring to FIG. 3, the adjustability of the bolster position can be further explained by mountings on the opposite surface of the lower housing section can be illustrated. As illustrated in FIG. 3, bolster 10*a* is detached from the lower housing 10*c* to show the connections therebetween.

Specifically, bolster 10*b* has on its rear surface six threaded studs 72 which are positioned to fit within six holes 70 on lower housing 10*c*. Washers and nuts 73 are threaded onto stud 72 after stud 72 is inserted through holes 70, to hold the bolster 10*b* in a desired vertical position. Holes 70 are elongated in a vertical direction thus permitting vertical adjustment in the position of a bolster. Similar connections are used with the bolster 10*a* to provide adjustability of the height of bolster 10*a*. Additional structures such as extender panels, positioned between housing section 10*c* and the bolster, can be used for horizontal adjustment of the position of the bolsters 10*a*, 10*b*, if such is desired to permit fitting the power generation unit to a given pickup truck.

Figure 4:
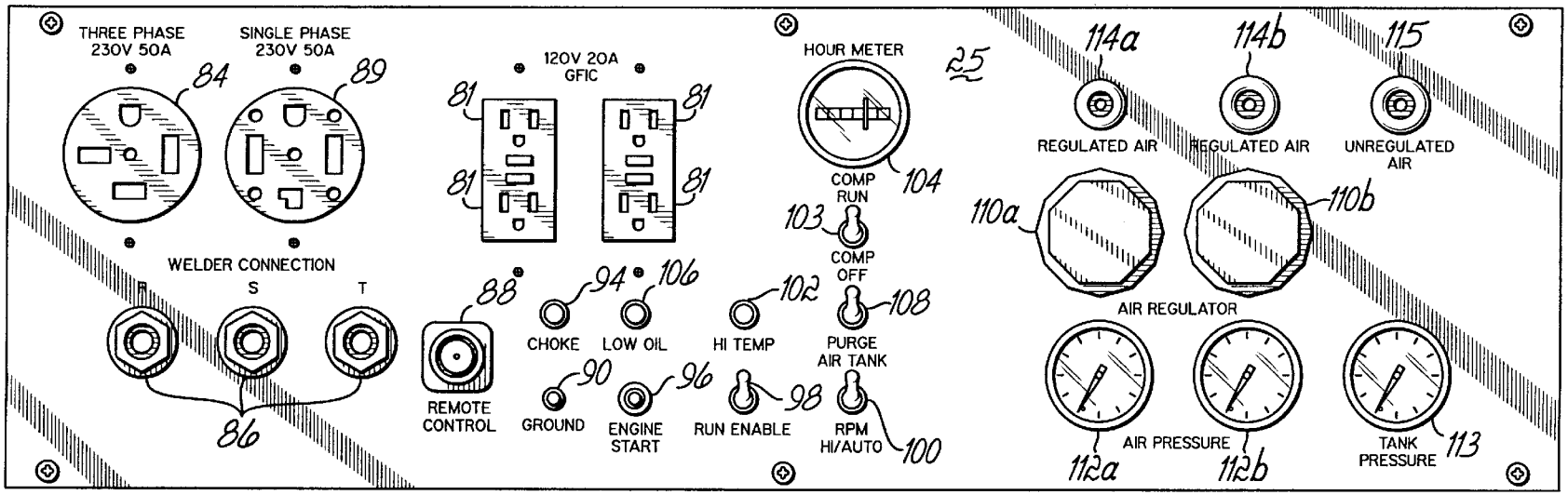
FIG. 4 illustrates a control panel of the integrated power unit of FIG. 1.

Referring to FIG. 4, a control panel 25 for the power generating unit 10 is mounted on bolster 10*b*. The alternator 42 provides power for four 120 volt 20 amp, ground fault interrupt (GFI) protected receptacles 81, a single phase, 230 volt, 30 amp receptacle 89 and a three-phase, 230 volt, 30 amp receptacle 84. Thus, substantially all of the electrical devices that might be operated with the power generating unit can be connected to an appropriate electrical connection. The three phases of electrical power from alternator unit 42 are protected by the triple circuit breaker 92 (FIG. 2) to provide interruption in the case of excessive current.

Further, the control panel 25 has electrical connections in the form of an R, S and T connector set 86 for providing three-phase electrical power used with a welding power supply. As noted above, when welding unit 44 is removed for use at a remote location, connections may be made to connectors 86 to the remote location to provide power to the welder power supply. In such a situation, remote control signals may be provided through a connector 88. When a welding connection or another high voltage connection is made to the power generating unit, a ground terminal 90 may be used to provide adequate grounding for the unit and the tools being used therewith.

In addition, the control 25 panel has controls for the internal combustion engine 40 within the power generating unit. Specifically, a choke control, engine start button and rpm switch 94, 96, 100, respectively, are used to start the engine as is known in the art. The engine ignition is enabled by run enable switch 98, as is also known in the art. Further, readouts provide information on the engine condition. For example, high engine temperature is identified by a warning lamp 102. A count of the total running hours of the internal combustion engine is provided by a meter 104. Finally, a low engine oil condition is identified by a warning lamp 106.

As noted above with reference to FIG. 2, a manual purge valve 108 is incorporated into the control panel 25 of the power generating unit. By actuating this control valve on the control panel, an operator may purge the air storage tanks 46*a*, 46*b* without need to access those tanks within the power generating unit. This facilitates tank purging and thus insure that the tanks are purged at the appropriate schedule.

The control panel 25 also includes controls and readouts for pressurized air produced by the power generating unit. Three connectors 114*a*, 114*b*, 115 provide pressurized air from the power generating unit. The connectors 114*a*, 114*b* are fluidly connected to respective air regulating valves 110*a*, 110*b*. The air pressures being provided to the connectors 114*a*, 114*b* is measured and displayed by respective air pressure gauges 112*a*, 112*b*. The connector 115 provides a source of unregulated tank air that is measured and displayed by pressure gauge 113. The control panel 25 also has a compressor switch 103 that functions to respectively enable and disable stop the compressors 48–51, for example, turn the compressors 48–51 on and off.

The control panel may also include a remote actuator for opening a latch holding down a lid or top 82 (FIG. 5) on lower housing section 10*c*. The remote handle may be connected by a cable to the latch so that the lid for the lower housing section 10*c* can be opened from the control panel.

Referring to FIG. 5, the assembly of components of the power generating unit can be explained in further detail. Specifically, lower housing 10*c* is assembled by initially mounting each of the power generating units, such as the internal combustion engine 40, air tanks 46, compressors 48 and battery 52 onto a support plate 78. Support plate 78 has cushioned mounting feet 79 to provide vibration reduction when support plate 78 is mounted in lower housing 10*c*. It can be seen that baffle 47 discussed above is inserted between the power generating components on support plate 78 to divert and control the flow of air through compartments of the lower housing 10*c* once the unit is assembled. FIG. 5 further illustrates the removable power welding unit 44, which is installed into lower housing 10*c* through door 24. As noted above, welding power supply 44 is portable and can be carried to work site or installed into lower housing 10*c* for use at the location of the power generating unit 10.

Figure 6:
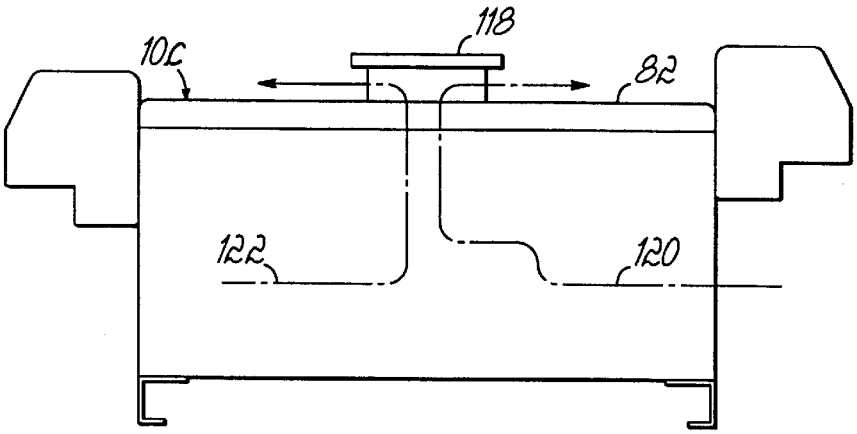
FIG. 6 is a schematic drawing of one alternative air ventilation flow for the integrated power units of FIGS. 1 and 6.

In the embodiment described with respect to FIGS. 1–5, two separate ventilation air flow paths are used to cool the engine compartment 57 and the other components in the lower housing 10*c*. As will be appreciated, other ventilation air flow paths may be more effective. For example, referring to FIG. 6, a capped vent 118 can be mounted on the top of the lid 82 to provide a ventilation air discharge path through the top of the lower housing 10*c*. In this embodiment, the air flow path 120 for the engine 40 would be vented into the plenum 35 (FIG. 5) and then vented out the top of the plenum 35 via an appropriate duct. The second air flow path 122 could be vented out of the top of the alternator housing 95 on the left side of the baffle 53 and vented up to the outlet vent 118 (FIG. 6) via appropriate ducting. Alternatively, the ventilation air may be vented out the top of the housing 95 on the right hand side of the baffle 53 and into the plenum 35 to facilitate cooling of the muffler 34 and thereafter, ducted to the outlet vent 118. As will be appreciated, some relocation of components, for example, breaker box 93, may be required to accommodate these alternative ventilation air flow paths.

Figure 7:
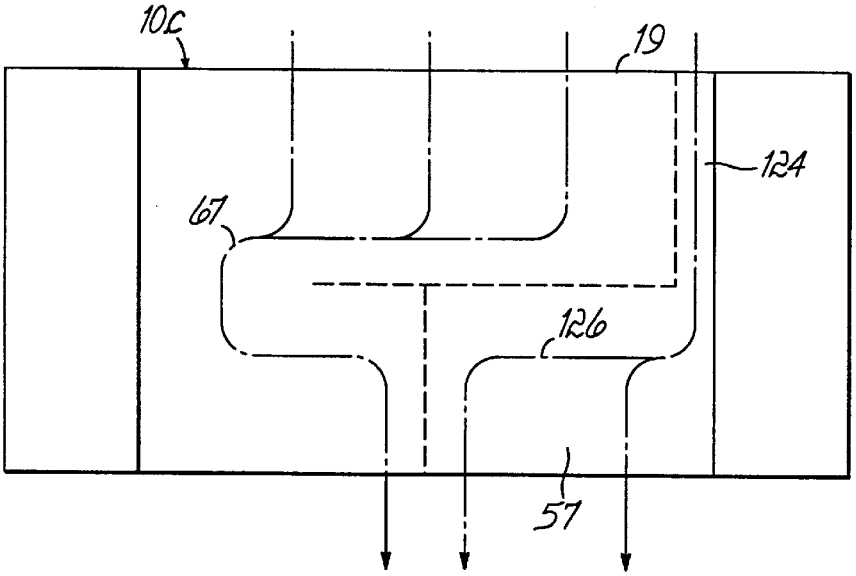
FIG. 7 is a schematic drawing of another alternative air ventilation flow for the integrated power units of FIGS. 1 and 6.

Referring to FIG. 7, another embodiment of ventilation air flow paths is schematically illustrated. The air flow path 67 is identical to that previously described with respect to FIG. 2. However, the engine compartment 57 is cooled by receiving ventilation air from the front side 19 of the lower housing 10*c*. With this embodiment, a vent is added to the front side 19; and a duct 124 provides ventilation air along air flow path 126. Once ventilation air is inside the engine compartment 57, it is routed to provide a cooling effect in a manner similar to that previously described with respect to ventilation air flow path 65. The duct 124 would extend from the front wall 19 and between the bracket 30 (FIG. 5) and the right end wall 21. The duct 124 would also require an appropriate cutaway in the baffle 47 to obtain access to the engine compartment 57.

Figure 8:
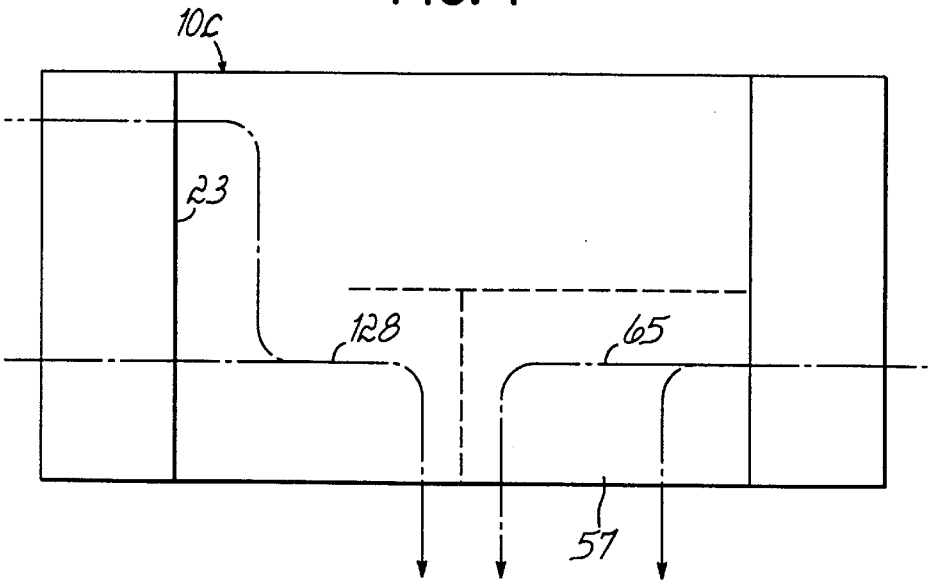
FIG. 8 is a schematic drawing of a further alternative air ventilation flow for the integrated power units of FIGS. 1 and 6.

In a further embodiment of ventilation air flow paths that is schematically illustrated in FIG. 8, the engine compartment 57 is cooled with a ventilation air flow path 65 as previously described. The remainder of the interior of the lower housing 10*c* is cooled by an air flow path 128 that receives ventilation air through vents located in the left end wall 23 of the lower housing. As will be appreciated, such inlet vents in the end wall 23 may be used in place of the vents 74–76 in the front wall 19 or in combination with such vents. In that event, the cross-sectional area of the various vents would be adjusted to provide the desired air flow patterns and cooling effect.

Figure 9:
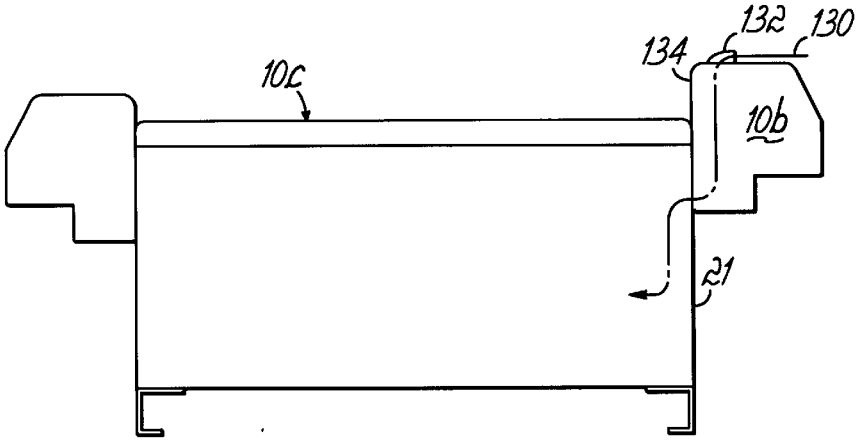
FIG. 9 is a schematic drawing of a still further air ventilation flow for the integrated power units of FIGS. 1 and 6.

FIG. 9 is a schematic illustration of another alternative embodiment for providing ventilation air to the lower housing 10*c*. In this embodiment, ventilation air path 130 is provided through a bolster 10*b*. A vent 132 is constructed on top of the bolster 10*b*, thereby allowing ventilation air to circulate through its interior. Contiguous ventilation holes are provided in the rear wall 134 of the bolster 10*b* in the right end wall 21 of the lower housing 10*c* to permit the ventilation air flow path to enter the interior of the lower housing 10*c*. As will be appreciated, the ventilation air flow path 130 may be routed within the lower housing 10*c* to provide cooling for the engine 40, other components within the lower housing 10*c* or all of the components therein. Air flow through bolster 10*b* can also provide cooling to wiring for the control panel 25 when located in bolster 10*b*.

Figure 10:
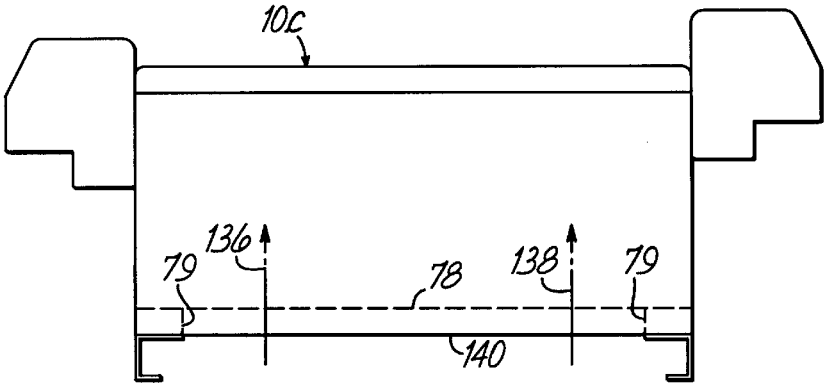
FIG. 10 is a schematic drawing of yet another alternative air ventilation flow for the integrated power units of FIGS. 1 and 6.

A still further embodiment for providing ventilation air is schematically illustrated in FIG. 10. In this embodiment, one or more ventilation air flow paths 136, 138 are provided by ventilation holes in the bottom 140 of the lower housing 10*c*. In addition, ventilation holes would also be provided at appropriate locations in the support plate 78. As will be appreciated, ventilation air between the support plate 78 and the bottom 140 may be provided by vents at the appropriate location in the side walls of the lower housing 10*c*.

While the present invention has been illustrated by a description of various embodiments and while these embodiments have been described in considerable detail, there is no intention to restrict or in any way limit the scope of the appended claims to such detail. Additional advantages and modifications will readily appear to those skilled in the art. For example, plate 78 might not be used; and in its place, units inside of lower housing section 10*c* could be mounted directly to the floor of lower housing section 10*c*. Each of the vibration-generating units (e.g., the compressors, engine and alternator) could be provided with vibration insulating feet where they mount to the lower housing section 10*c*. Further, in the described embodiment, two upper housings 10*a*, 10*b* are attached to the lower housing 10*c*. As will be appreciated, in other embodiments of the invention, only one of the upper housings could be used. Further, the engine 40 is described as an air cooled, gasoline engine. However, as will be appreciated, other types of engines can be used, for example, a liquid cooled engine or a diesel engine, etc.

The invention in its broader aspects is, therefore, not limited to the specific details, representative apparatus and method, and illustrative example shown and described. Accordingly, departures may be made from such details without departing from the spirit or scope of Applicant's general inventive concept.

What is claimed is:

1. An integrated power unit for use with a pickup truck having a truck bed with opposed sidewalls, the integrated power unit comprising:

a lower housing having a front wall and adapted to be placed in the truck bed between the opposed sidewalls;

a power unit disposed within the lower housing;

a compressor disposed within the lower housing;

a compressed air tank disposed within the lower housing adjacent the front wall thereof, the compressed air tank being fluidly connected to the compressor for storing compressed air and providing compressed air to a connector fluidly connected to the compressed air tank;

a manual purge valve fluidly connected to the compressed air tank and operable to permit a liquid to be purged from the compressed air tank;

a purge outlet fluidly connected to the purge valve and extending through the front wall of the lower housing, the purge outlet directing the liquid from the purge valve to a location outside the lower housing; and an upper housing extending from the lower housing and adapted to extend over a sidewall of the truck bed.

2. The integrated power unit of claim 1 wherein the purge outlet is located at a lower edge of the front wall of the lower housing.

3. The integrated power unit of claim 1 wherein the power unit is located adjacent a rear wall of the lower housing.

4. The integrated power unit of claim 1 further comprising an electric power generator electrically connected to the compressor.

5. The integrated power unit of claim 4 further comprising a welding power supply electrically connected to the electric power generator.

6. An integrated power unit for use with a pickup truck having a truck bed with opposed sidewalls, the integrated power unit comprising:

a housing having a wall with ventilation openings, the housing adapted to be placed in the truck bed between the opposed sidewalls;

an electrical power generating unit disposed within the housing and generating electrical power; and a plurality of electrically powered compressors disposed in the housing and connected to the electrical power generating unit, each of the plurality of compressors having a direct and unobstructed cooling air path between a respective compressor and the ventilation openings.

7. The integrated power unit of claim 6 wherein each of the plurality of compressors has a cooling air inlet located adjacent the ventilation openings so that there is a direct unobstructed cooling air path between the ventilation openings and the cooling air inlet.

8. The integrated power unit of claim 7 wherein the ventilation openings are in a front wall of the housing.

9. The integrated power unit of claim 6 further comprising at least three electrically powered compressors.

10. The integrated power unit of claim 6 further comprising four electrically powered compressors.

11. The integrated power unit of claim 6 wherein the electrical power generating unit further comprises an alternator.

12. The integrated power unit of claim 6 wherein the plurality of cooling air flow paths are substantially parallel cooling air flow paths in the housing.

13. The integrated power unit of claim 12 wherein the plurality of compressors have a plurality of respective centerlines oriented so that the plurality of respective centerlines are oblique to a longitudinal centerline of the truck.

14. An integrated power unit for use with a pickup truck having a truck bed with opposed sidewalls, the integrated power unit comprising:

a housing adapted to be placed in the truck bed between the opposed sidewalls;

an engine having a muffler and disposed within the housing;

a power converting unit disposed within the housing and mechanically coupled to the engine;

a plenum disposed around the muffler;

the housing having internal structure forming a first air flow path within the housing for receiving first cooling air from a first location outside the housing and directing the first cooling air past the engine, through the plenum and to a location outside of the housing; and a separate second air flow path within the housing for receiving separate cooling air from a different location outside the housing and directing the separate cooling air past the power converting unit and then to a location outside of the housing, the separate cooling air not being used to cool the engine.

15. The integrated power unit of claim 14 wherein the power converting unit comprises an alternator.

16. The integrated power unit of claim 14 wherein the power converting unit further comprises a compressor.

17. An integrated power unit for use with a pickup truck having a truck bed with opposed sidewalls, the integrated power unit comprising:

a lower housing adapted to be placed in the truck bed between the opposed sidewalls, the lower housing having a lid movable with respect to the lower housing;

an engine disposed within the lower housing and generating electrical and/or mechanical power;

an upper housing extending from the lower housing and adapted to extend over a sidewall of the truck bed; and a switch disposed to detect closed and open positions of the lid, and the switch being electrically connected with the internal combustion engine to disable the internal combustion engine in response to the lid being opened.

18. The integrated power unit of claim 17 wherein the switch is disposed in the lower housing.

19. An integrated power unit for use with a pickup truck having a truck bed with opposed sidewalls, the integrated power unit comprising:

a lower housing adapted to be placed in the truck bed between the opposed sidewalls;

an electrical power generating unit disposed within the housing and generating electrical power;

a plurality of electrical breakers disposed within the lower housing and electrically connected to the electrical power generating unit; and an upper housing extending from the lower housing and adapted to extend over a sidewall of the truck bed.

20. The integrated power unit of claim 19 wherein the lower housing further comprises a lid movable with respect to the lower housing to provide access to the plurality of electrical breakers.

21. An integrated power unit for use with a pickup truck having a truck bed with opposed sidewalls, the integrated power unit comprising:

a lower housing adapted to be placed in the truck bed between the opposed sidewalls;

a power unit disposed within the lower housing;

a compressor disposed within the lower housing and operatively connected to the power unit;

a compressed air tank disposed within the lower housing and fluidly connected to the compressor;

a control panel disposed in the upper housing and having a gauge fluidly connected to the compressed air tank for displaying fluid pressure within the compressed air tank; and an upper housing extending from the lower housing and adapted to extend over a sidewall of the truck bed.

22. The integrated power unit of claim 21 wherein the control panel further has a switch for enabling and disabling the compressor.

23. An integrated power unit for use with a pickup truck having a truck bed with opposed sidewalls, the integrated power unit comprising:

a lower housing adapted to be placed in the truck bed between the opposed sidewalls;

a power unit disposed within the lower housing;

a compressor disposed within the lower housing and operatively connected to the power unit;

a compressed airtank disposed within the lower housing and fluidly connected to the compressor;

a control panel having a compressed air connector fluidly connected directly to the compressed air tank without an intervening regulator; and an upper housing extending from the lower housing and adapted to extend over a sidewall of the truck bed.

24. An integrated power unit for use with a pickup truck having a truck bed with opposed sidewalls, the integrated power unit comprising:

a lower housing adapted to be placed in the truck bed between the opposed sidewalls;

a power unit disposed within the lower housing;

a compressor disposed within the lower housing and operatively connected to the power unit;

a compressed air tank disposed within the lower housing and fluidly connected to the compressor;

a control panel disposed in the upper housing and having a switch for enabling and disabling the compressor; and an upper housing extending from the lower housing and adapted to extend over a sidewall of the truck bed.

25. An integrated power unit for use with a pickup truck having a truck bed with opposed sidewalls, the integrated power unit comprising:

a lower housing having front, rear and opposed end walls and adapted to be placed in the truck bed between the opposed sidewalls;

an engine disposed within the lower housing;

a plurality of power converting units disposed within the lower housing and operatively connected to the engine;

an upper housing extending from the lower housing and adapted to extend over a sidewall of the truck bed;

a first air flow path having vent openings in the front and rear walls of the lower housing and receiving cooling air from outside the lower housing and directing the cooling air past the engine to a location outside the lower housing; and a second airflow path within the lower housing for receiving cooling air from a plurality of locations outside one of the housings and directing the cooling air from separate ones of the plural locations, respectively past separate ones of the power converting units and to a location outside one of the housings.

26. The integrated power unit of claim 25 wherein the lower housing has front, rear and opposed end walls and the first air flow path further comprises vent openings in one of the end walls and the front wall.

27. The integrated power unit of claim 25 wherein the lower housing has a top wall and the first air flow path further comprises a vent opening in the top wall.

28. The integrated power unit of claim 25 wherein the lower housing has a top wall and the second air flow path further comprises a vent opening in the top wall.

29. An integrated power unit for use with a pickup truck having a truck bed with opposed sidewalls, the integrated power unit comprising:

a lower housing having front rear and opposed end walls and adapted to be placed in the truck bed between the opposed sidewalls;

an engine disposed within the lower housing;

a plurality of power converting units disposed within the lower housing and operatively connected to the engine;

an upper housing extending from the lower housing and adapted to extend over a sidewall of the truck bed;

a first air flow path within the lower housing and having a vent opening in the upper housing for receiving cooling air from outside one of the housings and directing the cooling air past the engine to a location outside an other of the housings; and a second airflow path within the lower housing for receiving cooling air from a plurality of locations outside one of the housings and directing the cooling air from separate ones of the plural locations, respectively past separate ones of the power converting units and to a location outside one of the housings.

30. An integrated power unit for use with a pickup truck having a truck bed with opposed sidewalls, the integrated power unit comprising:

a lower housing having a bottom wall and adapted to be placed in the truck bed between the opposed sidewalls;

an engine disposed within the lower housing;

a plurality of power converting units disposed within the lower housing and operatively connected to the engine;

an upper housing extending from the lower housing and adapted to extend over a sidewall of the truck bed;

a first air flow path comprises a vent opening in the bottom wall of the lower housing for receiving cooling air from outside one of the housings and directing the cooling air past the engine to a location outside one of the housings; and a second airflow path within the lower housing for receiving cooling air from a plurality of locations outside one of the housings and directing the cooling air from separate ones of the plural locations, respectively past separate ones of the power converting units and to a location outside one of the housings.

31. An integrated power unit for use with a pickup truck having a truck bed with opposed sidewalls, the integrated power unit comprising:

a lower housing having front, rear and opposed end walls and adapted to be placed in the truck bed between the opposed sidewalls;

an engine disposed within the lower housing;

a plurality of power converting units disposed within the lower housing and operatively connected to the engine;

an upper housing extending from the lower housing and adapted to extend over a sidewall of the truck bed;

a first airflow path within the lower housing for receiving cooling air from outside one of the housings and directing the cooling air past the engine to a location outside one of the housings; and a second air flow path comprises vent openings in the front and rear walls within the lower housing for receiving cooling air from a plurality of locations outside one of the housings and directing the cooling air from separate ones of the plural locations, respectively past separate ones of the power converting units and to a location outside one of the housings.

32. An integrated power unit for use with a pickup truck having a truck bed with opposed sidewalls, the integrated power unit comprising:

a lower housing having front, rear and opposed end walls and adapted to be placed in the truck bed between the opposed sidewalls;

an engine disposed within the lower housing;

a plurality of power converting units disposed within the lower housing and operatively connected to the engine;

an upper housing extending from the lower housing and adapted to extend over a sidewall of the truck bed;

a first air flow path within the lower housing for receiving cooling air from outside one of the housings and directing the cooling air past the engine to a location outside one of the housings; and a second air flow path comprises vent openings in one of the end walls and the rear wall within the lower housing for receiving cooling air from a plurality of locations outside one of the housings and directing the cooling air from separate ones of the plural locations, respectively past separate ones of the power converting units and to a location outside one of the housings.

33. An integrated power unit for use with a pickup truck having a truck bed with opposed sidewalls, the integrated power unit comprising:

a lower housing having front rear and opposed end walls and adapted to be placed in the truck bed between the opposed sidewalls;

an engine disposed within the lower housing;

a plurality of power converting units disposed within the lower housing and operatively connected to the engine;

an upper housing having a vent opening therein, the upper housing extending from the lower housing and adapted to extend over a sidewall of the truck bed;

a first air flow path within the lower housing for receiving cooling air from outside one of the housings and directing the cooling air past the engine to a location outside one of the housings; and a second airflow path within the lower housing for receiving cooling air from a plurality of locations outside one of the housings and directing the cooling air from separate ones of the plural locations, respectively past separate ones of the power converting units and to a location outside one of the housings, one of the first and second air flow paths further comprises the vent opening in the upper housing.

34. An integrated power unit for use with a pickup truck having a truck bed with opposed sidewalls, the integrated power unit comprising:

a lower housing having a bottom wall with a vent opening therein and adapted to be placed in the truck bed between the opposed sidewalls;

an engine disposed within the lower housing;

a plurality of power converting units disposed within the lower housing and operatively connected to the engine;

an upper housing extending from the lower housing and adapted to extend over a sidewall of the truck bed;

a first air flow path within the lower housing for receiving cooling air from outside one of the housings and directing the cooling air past the engine to a location outside one of the housings; and a second air flow path with in the lower housing for receiving cooling air from a plurality of locations outside one of the housings and directing the cooling air from separate ones of the plural locations, respectively past separate ones of the power converting units and to a location outside one of the housings, one of the first and second air flow paths further comprises the vent opening in the bottom wall.

35. An integrated power unit for use with a pickup truck having a truck bed with opposed sidewalls, the integrated power unit comprising:

a lower housing adapted to be placed in the truck bed between the opposed sidewalls;

an engine disposed within the lower housing;

a power converting unit disposed within the lower housing and mechanically coupled to the engine;

an upper housing extending from the lower housing and adapted to extend over a sidewall of the truck bed; and an air vent located in a sidewall of one of the housings for receiving ventilation air from inside the one of the housings and directing the ventilation air in an upward direction outside the one of the housings, the air vent comprising ventilation holes in the sidewall for directing the ventilation air outside the one of the housings, and a louvered vent disposed adjacent the ventilation holes for directing the ventilation air in the upward direction, the louvered vent being located outward and away from the sidewall of the one of the housings.

36. The integrated power unit of claim 35 wherein the louvered vent is located outside the one of the housings and mounted to the one of the housings immediately adjacent to, but displaced from, the ventilation holes.

37. The integrated power unit of claim 36 wherein the louvers are angled with respect to the ventilation holes for directing the ventilation air in a substantially upward direction.

38. The integrated power unit of claim 37 wherein the air vent is located in a sidewall of the lower housing.

39. An integrated power unit for use with a pickup truck having a truck bed with opposed sidewalls, the integrated power unit comprising:

a lower housing adapted to be placed in the truck bed between the opposed sidewalls;

an engine disposed within the lower housing;

a power converting unit disposed within the lower housing and mechanically coupled to the engine;

an upper housing extending from the lower housing and adapted to extend over a sidewall of the truck bed; and an air vent located in a rear wall of the lower housing for receiving ventilation air from inside the one of the housings and directing the ventilation air in an upward direction outside the one of the housings, the air vent comprising ventilation holes in the sidewall for directing the ventilation air outside the one of the housings, and louvers disposed adjacent the ventilation holes for directing the ventilation air in the upward direction.

40. An integrated power unit for use with a pickup truck having a truck bed with opposed sidewalls, the integrated power unit comprising:

a lower housing adapted to be placed in the truck bed between the opposed sidewalls, the lower housing having a bottom wall;

an engine disposed within the lower housing;

a power converting unit disposed within the lower housing and mechanically coupled to the engine;

an upper housing extending from the lower housing and adapted to extend over a sidewall of the truck bed;

the lower housing forming a first air flow path within the lower housing for receiving cooling air from outside the housings and directing the cooling air past the engine to a location outside the housings; and the lower housing forming a second air flow path within the lower housing for receiving cooling air from openings in the bottom wall of the lower housing and directing the cooling air past the power converting unit to a location outside of the housings.

41. An integrated power unit for use with a pickup truck having a truck bed with opposed sidewalls, the integrated power unit comprising:

a lower housing adapted to be placed in the truck bed between the opposed sidewalls, the lower housing having a top wall with a lip extending around a periphery of a hole in the top wall;

a lid movable over the opening in the top wall and having a peripheral groove disposable over the lip to seal the lid over the opening in the top wall;

an engine disposed within the lower housing;

a power converting unit disposed within the lower housing and mechanically coupled to the engine; and an upper housing extending from the lower housing and adapted to extend over a sidewall of the truck bed.

* * * * *